US008136248B2

(12) United States Patent
Beavers, Jr. et al.

(10) Patent No.: US 8,136,248 B2
(45) Date of Patent: Mar. 20, 2012

(54) METHOD OF MAKING BUILDING PANELS WITH SUPPORT MEMBERS EXTENDING PARTIALLY THROUGH THE PANELS

(75) Inventors: James L. Beavers, Jr., Prescott, AZ (US); Bruce B. Solper, Skull Valley, AZ (US)

(73) Assignee: Global Building Systems, Inc., Prescott, AZ (US)

( * ) Notice: Subject to any disclaimer, the term of this patent is extended or adjusted under 35 U.S.C. 154(b) by 0 days.

(21) Appl. No.: 12/855,614

(22) Filed: Aug. 12, 2010

(65) Prior Publication Data

US 2010/0300012 A1 Dec. 2, 2010

Related U.S. Application Data

(63) Continuation of application No. 11/626,991, filed on Jan. 25, 2007, now abandoned.

(51) Int. Cl.
*E04B 1/02* (2006.01)
*B21D 47/04* (2006.01)

(52) U.S. Cl. ..... 29/897.3; 52/309.7; 52/742.13; 264/241

(58) Field of Classification Search ..... 52/309.7, 52/309.2, 309.16, 309.11, 309.4, 801.11, 52/800.1, 790.1, 745.19, 742.13, 742.14, 52/846, 506.07; 29/897.35, 897.312, 897.32, 29/897.3; 264/241, 267; 249/35
See application file for complete search history.

(56) References Cited

U.S. PATENT DOCUMENTS

| | | | | |
|---|---|---|---|---|
| 999,752 | A | 8/1911 | Connell | |
| 1,090,171 | A * | 3/1914 | Schisler | 52/844 |
| 1,661,128 | A | 2/1928 | Mankedick | |
| 2,585,082 | A | 2/1952 | Bollinger, Jr. | |
| 3,039,414 | A * | 6/1962 | Rosanes | 29/897.35 |
| 3,271,920 | A | 9/1966 | Downing, Jr. | |
| 3,295,278 | A | 1/1967 | Muhm | |
| 3,344,572 | A | 10/1967 | Sell | |
| 3,353,315 | A * | 11/1967 | Barker | 52/275 |
| 3,736,715 | A | 6/1973 | Krumwiede | |

(Continued)

OTHER PUBLICATIONS

Building Panel Combines Foam Insulation and Steel Frame—Published by oikos and Energy Source Buikder # 37 Feb. 1995.

(Continued)

*Primary Examiner* — Robert Canfield
*Assistant Examiner* — Christine T Cajilig
(74) *Attorney, Agent, or Firm* — Robert D. Atkins; Patent Law Group: Atkins & Associates, P.C.

(57) ABSTRACT

A building panel for residential and commercial construction uses a plurality of insulating blocks connected together by adhesive. The insulation blocks are typically made of foam. A plurality of support members are disposed on opposite sides of the insulating blocks and offset with respect to the adjacent support member. The support member are typically made of metal and can have different shapes including "T" shape, "U" shape, and "L" shape. Each support member has a head portion in contact with a surface of the insulating block and a stem portion extending into the insulating block and having a length less than a width of the insulating block so that a thermal conduction path of the support member is discontinuous across the insulating block. The panel can be used as a curtain wall panel in high-rise construction, as well as bodies for aircraft, automotive, and marine applications.

9 Claims, 9 Drawing Sheets

U.S. PATENT DOCUMENTS

| | | | | | |
|---|---|---|---|---|---|
| 3,748,998 | A | | 7/1973 | Lambert | |
| 3,839,839 | A | | 10/1974 | Tillisch | |
| 3,940,899 | A | | 3/1976 | Balinski | |
| 4,047,355 | A | | 9/1977 | Knorr | |
| 4,152,873 | A | * | 5/1979 | Burke | 52/1 |
| 4,284,447 | A | | 8/1981 | Dickens | |
| 4,353,192 | A | | 10/1982 | Pearson et al. | |
| 4,435,936 | A | | 3/1984 | Rutkowski | |
| 4,641,468 | A | | 2/1987 | Slater | |
| 4,754,587 | A | | 7/1988 | Glaser | |
| 4,866,899 | A | | 9/1989 | Houser | |
| 4,905,440 | A | | 3/1990 | Schilger | |
| 4,930,278 | A | | 6/1990 | Staresina et al. | |
| 4,961,298 | A | * | 10/1990 | Nogradi | 52/235 |
| 4,970,838 | A | | 11/1990 | Phillips | |
| 5,033,248 | A | | 7/1991 | Phillips | |
| 5,285,615 | A | | 2/1994 | Gilmour | |
| 5,515,659 | A | | 5/1996 | MacDonald et al. | |
| 5,524,400 | A | | 6/1996 | Schmechel | |
| 5,527,625 | A | | 6/1996 | Bodnar | |
| 5,799,462 | A | | 9/1998 | McKinney | |
| 5,893,248 | A | | 4/1999 | Beliveau | |
| 6,145,257 | A | | 11/2000 | Cappuccio | |
| 6,164,035 | A | * | 12/2000 | Roberts | 52/563 |
| 6,240,693 | B1 | * | 6/2001 | Komasara et al. | 52/439 |
| 6,321,505 | B1 | | 11/2001 | Packman et al. | |
| 6,401,417 | B1 | | 6/2002 | Leblang | |
| 6,408,594 | B1 | | 6/2002 | Porter | |
| 6,519,904 | B1 | | 2/2003 | Phillips | |
| 6,708,459 | B2 | | 3/2004 | Bodnar | |
| 6,796,093 | B2 | | 9/2004 | Brandes | |
| 2002/0134043 | A1 | | 9/2002 | Winterfeld | |
| 2005/0257494 | A1 | | 11/2005 | Brandes | |
| 2006/0075701 | A1 | | 4/2006 | Cretti | |
| 2006/0191232 | A1 | | 8/2006 | Salazar et al. | |

OTHER PUBLICATIONS

Oikos, "Building Panel Combines Foam Insulation and Steel Frame", Energy Source Builder #37, Feb. 1995.

* cited by examiner

METHOD OF MAKING BUILDING PANELS WITH SUPPORT MEMBERS EXTENDING PARTIALLY THROUGH THE PANELS

CLAIM TO DOMESTIC PRIORITY

The present application is a continuation of U.S. patent application Ser. No. 11/626,991, filed Jan. 25, 2007, and claims priority to the foregoing parent application pursuant to 35 U.S.C. §120.

FIELD OF THE INVENTION

The present invention relates in general to construction materials and, more particularly, to residential and commercial building panels containing insulating foam and support members extending partially through the insulating foam.

BACKGROUND OF THE INVENTION

Residential and commercial building construction uses a variety of building materials and construction techniques to complete the structure. In some building projects, lumber or metal studs are used for the framing. The frame structure is held together with nails, screws, and bolts. An exterior siding such as stucco, wood, vinyl, brick, or aluminum is placed over the frame structure. Insulation is placed between the studs of the frame structure. The interior coverings such as drywall are affixed to the inside of the frame structure. The entire building project is typically performed on the construction site. The use of interior and exterior siding over frame is costly and labor and time intensive. Wood framing is of inferior quality and subject to insect damage and warping. Metal framing is thermally conductive which is undesirable in view of energy costs. The frame-based structure is susceptible to the effects of aging and storm damage. While frame construction has been dominant in the building industry for many years, other more cost effective and time efficient solutions are becoming more common.

One alternative building approach involves the use of hollow sectional forms, which are put together in the shape of the exterior wall. The hollow forms are filled with concrete and then disassembled when the concrete sets, leaving a concrete wall. The concrete wall is long-lasting and strong against the elements, but the forms are generally expensive to setup.

Another building approach involves the use of pre-fabricated building panels which are manufactured off-site and then assembled together on-site. One such building panel is discussed in U.S. Pat. No. 6,796,093 as having a plurality of I-beam-shaped metal struts spaced about 18 inches apart with insulating foam blocks disposed between the metal struts. The metal struts have cut-outs along the length of the I-beam to reduce the total metal area and associated thermal conductivity. FIG. 1 shows exemplary prior art I-beam metal strut 12 between foam blocks 14. While the structural panel has good load-bearing characteristics, the I-beam metal strut 12 is continuous across foam block 14, at least through portions of the metal struts and, consequently, is thermally conductive through the continuous metal areas. Since I-beams 12 go completely through foam blocks 14, heat and cold will conduct from one side to the other side of the wall structure. In the summer, I-beam 12 conducts heat from the exterior to the interior of the building. In the winter, I-beam 12 conducts cold from the exterior to the interior of the building. In any case, the I-beam construction decreases the thermal insulation property of the building panels.

A need exists for building panels combining strength with thermal insulating efficiency.

SUMMARY OF THE INVENTION

In one embodiment, the present invention is a method of manufacturing a building panel for use in building a residential or commercial structure off-site at a manufacturing location that is geographically separate from an assembly location where the building panel is incorporated into the residential or commercial structure. The method comprises assembling a plurality of panel forms to form a panel mold having a hollow cavity within the panel mold, an overall size and shape of the hollow cavity substantially defining an overall size and shape of the building panel, a width of the hollow cavity and a height of the hollow cavity substantially defining a width of the building panel and a height of the building panel, respectively.

The method further comprises providing a first metal sheet and bending the first metal sheet to form a first T-shaped support member having a length that is substantially the same as a length of the first metal sheet. Bending the first metal sheet to form the first T-shaped support member consists of bending the first metal sheet by substantially 90 degrees across the length of the first metal sheet to form a first portion of the first metal sheet and a second portion of the first metal sheet that is substantially perpendicular to the first portion of the first metal sheet, a length of the first portion of the first metal sheet less than the width of the hollow cavity. Bending the first metal sheet further consists of bending the second portion of the first metal sheet by substantially 180 degrees across the length of the first metal sheet to form a third portion of the first metal sheet that is substantially parallel to the second portion of the first metal sheet, and further consists of bending the third portion of the first metal sheet by substantially 180 degrees across the length of the first metal sheet to form a fourth portion of the first metal sheet such that the fourth portion of the first metal sheet is parallel to the third portion of the first metal sheet, and such that an end of the first metal sheet lies proximate to where the first metal sheet was bent by substantially 90 degrees across the length of the first metal sheet to form the first portion of the first metal sheet and the second portion of the first metal sheet.

The method further comprises disposing the first T-shaped support member within the hollow cavity such that the length of the first T-shaped support member is substantially parallel to the height of the hollow cavity, such that the third portion of the first metal sheet substantially abuts an interior surface of the panel mold, and such that the first portion of the first metal sheet is substantially parallel to the width of the panel mold.

The method further comprises providing a second metal sheet to form a planar support member having a length that is substantially the same as a length of the second metal sheet and disposing the planar support member within the hollow cavity such that the length of the planar support member is substantially parallel to the height of the hollow cavity, such that the planar support member does not contact the interior surface of the panel mold, and such that the planar support member forms a first angle with the interior surface of the panel mold, wherein the first angle is not a right angle. The method further comprises filling an unoccupied space in the hollow cavity of the panel mold with a semi-fluid insulating material and solidifying the semi-fluid insulating material to form an insulating material that surrounds and encases at least the first T-shaped support member and the planar support member.

In another embodiment, the present invention is a method of making a building panel comprising assembling a plurality of panel forms to form a panel mold having a hollow cavity within the panel mold, an overall size and shape of the hollow cavity substantially defining an overall size and shape of the building panel, the hollow cavity having a width and a height that is substantially the same as a width and a height of the building panel.

The method further comprises providing a first metal sheet, bending the first metal sheet to form a first support member having a length that is substantially the same as a length of the first metal sheet, wherein bending the first metal sheet to form the first support member consists of bending the first metal sheet by a first predetermined angle across the length of the first metal sheet to form a first portion of the first metal sheet, a second portion of the first metal sheet, and a bend connecting the first portion of the first metal sheet to the second portion of the first metal sheet.

The method further comprises disposing the first support member within the hollow cavity such that the length of the first support member is substantially parallel to the height of the hollow cavity and such that the first support member touches an interior surface of the panel mold only at the bend connecting the first portion of the first metal sheet to the second portion of the first metal sheet, filling an unoccupied space in the hollow cavity of the panel mold with a semi-fluid insulating material, and solidifying the semi-fluid insulating material to form an insulating material that surrounds and encases at least the first support member.

In another embodiment, the present invention is a method of manufacturing a building panel comprising providing an insulating block and providing a first metal sheet. The method further comprises bending the first metal sheet no more than three times to form a first support member consisting of a head portion and a stem portion, where the head portion and the stem portion substantially planar in shape, and where the stem portion is disposed substantially perpendicular to the head portion.

The method further comprises attaching the first support member to the insulating block such that a length of the first support member is substantially parallel to a height of the insulating block, and such that the head portion abuts a surface of the insulating block. The first support member is further attached to the insulating block such that the stem portion partially penetrates the insulating block from the surface of the insulating block, wherein the surface of the insulating block is normal to a thickness of the insulating block, and the thickness of the insulating block is less than the height of the insulating block and is less than a width of the insulating block.

In another embodiment, the present invention is a prefabricated building panel comprising an insulating block having a width spanning from a first outer surface of the insulating block to a second outer surface of the insulating block, the width of the insulating block corresponding to a width of the prefabricated building panel.

The prefabricated building panel further comprises a first support member affixed to the insulating block, the first support member having a cross-section in a direction that is perpendicular to a length of the first support member, the first support member affixed to the insulating block such that the length of the first support member is substantially parallel to a height of the insulating block. In this embodiment, the cross-section of the first support member consists of a head and a stem that are both substantially planar in shape, wherein the stem joins the head at substantially a ninety degree angle, wherein the head of the first support member is disposed at the first outer surface of the insulating block and is substantially parallel to the first outer surface of the insulating block, and wherein the stem of the first support member is surrounded and encased by the insulating block.

DETAILED DESCRIPTION OF THE DRAWINGS

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Residential, commercial, and industrial building construction can be done much more efficiently and cost effectively with pre-manufactured wall, roof, floor, and ceiling panels. The pre-manufactured panels can be made in a controlled environment, such as a manufacturing facility, shipped to the construction site, and then assembled together to form the walls and roof of the building. The pre-manufactured panels stand strong against adverse environmental conditions, such as wind, rain, snow, hurricane, flood, and earthquake. The wall and roof panels are easy to assemble into the complete building structure on the job site. As will be demonstrated, the wall and roof panels of the present invention provide improved insulation, i.e., higher R-value insulation factor, as compared to the prior art.

To construct a building with the wall and roof panels as described herein, an architect or builder will design and layout the building structure. The building may be a home, office, industrial, hotel, or commercial structure of any size and shape and as tall as the local building codes permit. The building designer will specify a blueprint of the building, including dimensions for the walls and roof. The designer then selects wall and roof panels to conform to the building blueprint, i.e., the walls and roof are made with a plurality of building panels assembled together according to the design.

The panels can be round, rectangle, triangle, curved, polygon, or any other convenient shape. The selected panels are connected together on the job site to form the walls and roof of the building. The building panels can be stacked on-end with appropriate support for multi-story structures.

Figure 2:
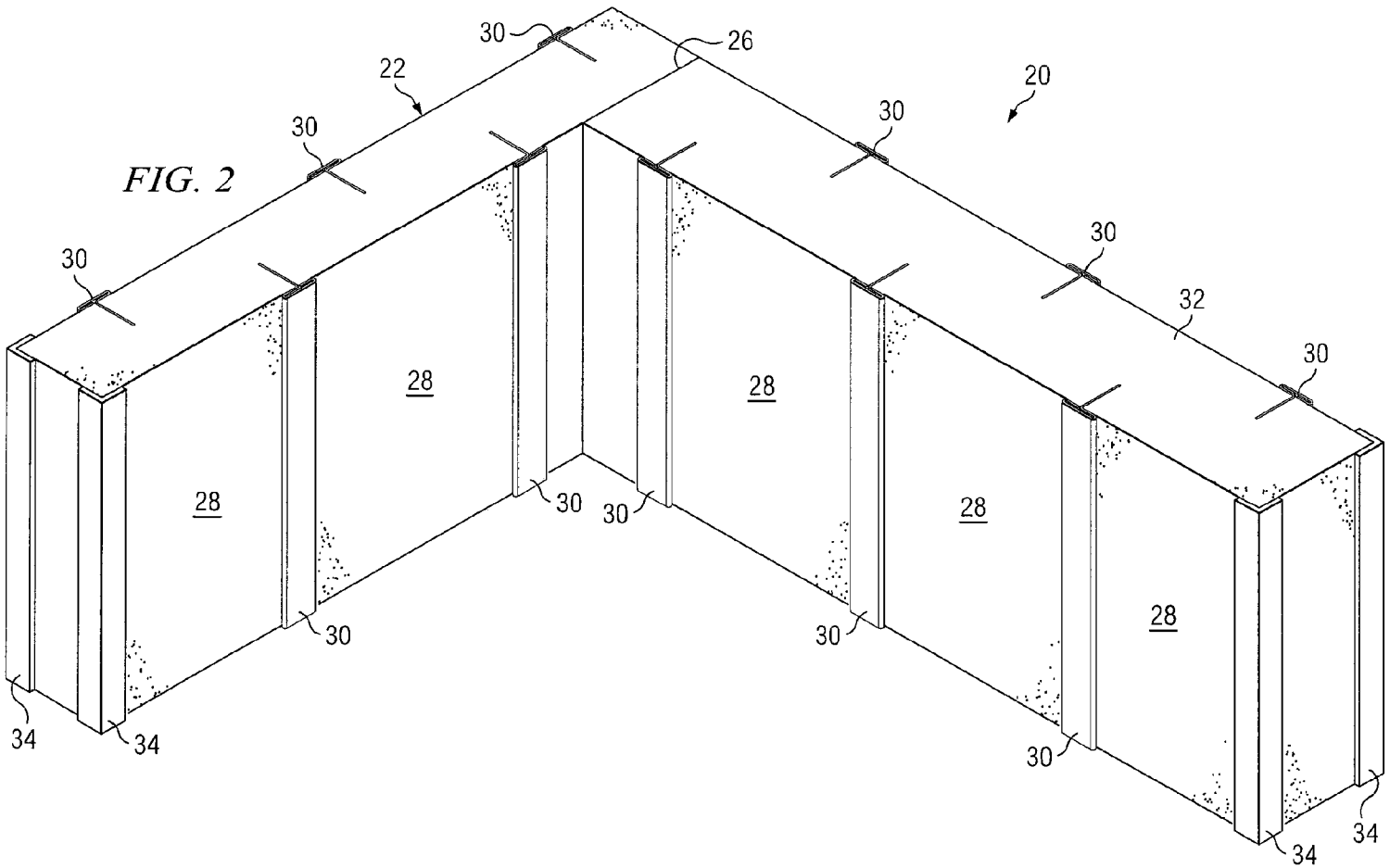
FIG. 2 illustrates interconnected foam-filled wall panels with support members inserted partially into the panel.

FIG. 2 illustrates a portion of building structure 20 with two building panels or sections 22 connected together at joint 26. Building panels are each made with one or more insulating blocks 28. The insulating blocks 28 may be made with expanded polystyrene (EPS) foam formed in 48-inch blocks. Alternatively, the blocks 28 can have other lengths and be made with fiberglass, paper, or any other thermally insulating material. The height of each insulating block depends on the building design, typically ranging from 8-10 feet. The thickness of the insulating blocks ranges from 4-8 inches. In other embodiments, the insulating blocks may range from 2 to 12 inches in thickness. For walls greater than 48 inches in length, a plurality of insulating blocks 28 are interconnected to run the length of the wall. Adjacent insulating blocks 28 are held together with an adhesive, e.g., urethane glue. Building panel 22 may have side end caps 34 for support and protection of the foam block. Building panel 22 may also have top and bottom end caps (not shown). The top cap is a metal angle or "L"-shaped brace running along the top perimeter of panel 22, contacting the top and sides of the insulating blocks. The bottom cap is a metal angle or "L"-shaped brace running along the bottom perimeter of panel 22, contacting the bottom and sides of the insulating blocks. For the wall panels, the bottom cap may be formed in or attached to the foundation of the building structure to aid in aligning the walls and to meet hurricane and earthquake standards.

Support members or struts 30 are inserted into insulating blocks 28 to provide structural support and withstand the environmental elements, e.g., wind, rain, and snow. The building panels 22 are also resistant to water, mold, mildew, insects, fire, hurricanes, and earthquakes. Support members 30 and insulating blocks 28 complement one another to provide a strong yet thermally isolating building panel. Support member 30 can be made from a variety of materials capable of providing structural support with the insulating block, such materials including metal (steel, aluminum or composite metal), ceramic, concrete, fiberglass, graphite, wood, plastic, cardboard, rubber, and composites of such materials.

In one embodiment, support members 30 are formed in the shape of a "T" and run the height of the wall, from top to bottom. The stem of support member 30 extends partially into the insulating block 28 but does not extend completely through the insulating block. The support members 30 are installed on opposite sides of panel 22, in an alternating pattern and offset or staggered with respect to the adjacent support members on the other side of the building panels, as shown in FIG. 2. The support members are about 12-18 inches apart on center of each member, and about 24-36 inches apart on each side of the building panel.

The use of panel 22 provides several advantages for building construction. The building panels can be made off-site, in a controlled environment such as a manufacturing facility, and then transported to and assembled at the building site. The off-site manufacturing provides cost saving efficiencies in terms of accessibility to mass production equipment, sheltered work environment, and ready access to raw materials. The building panels can be formed to any size and shape in accordance with the building design. The panels can be straight, curved, angled, etc. The insulating blocks 28 provide exceptional insulation properties against the outside elements. Each inch of thickness of the insulating block yields about R-4 insulation factor. A 6-inch thick foam panel would provide about R-24 value of insulation. The support members 30 provide structural strength to panel 22. With support members 30, an 8-foot by 8-foot by 6-inch section of panel 22 can withstand in excess of 27,000 lbs. of total axial loading directed against surface 32.

Figure 1:
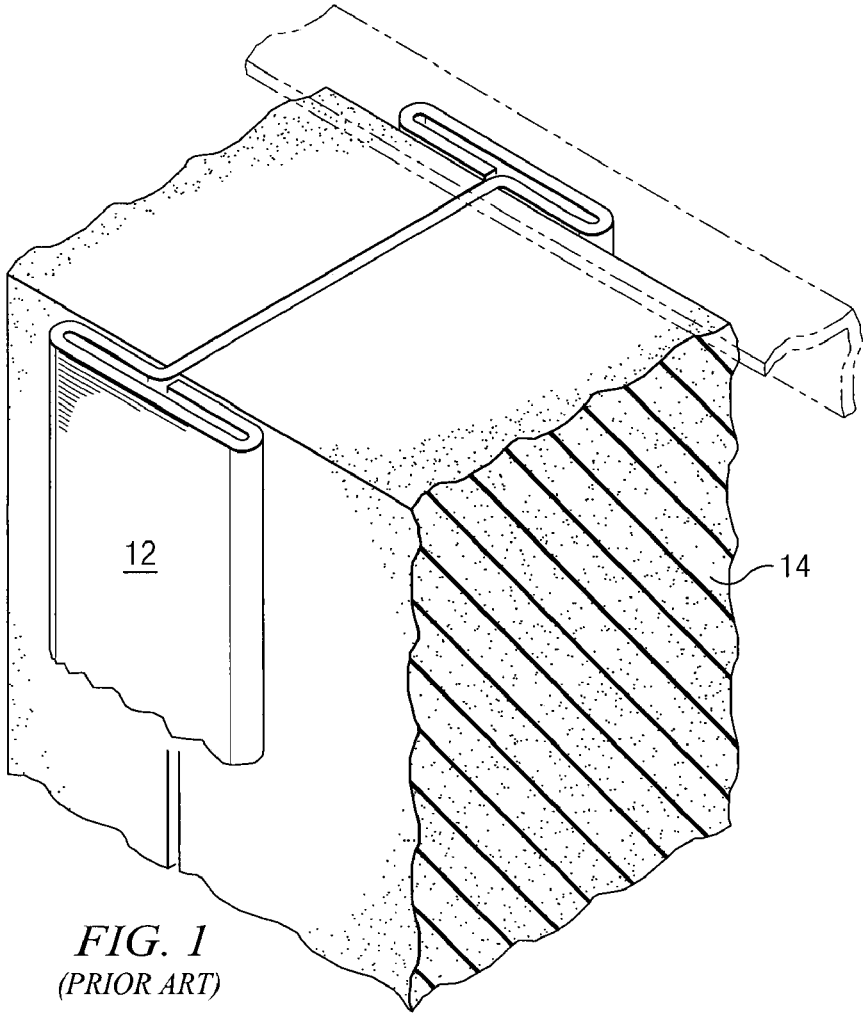
FIG. 1 (PRIOR ART)
FIG. 1 illustrates a known wall panel with I-beam strut disposed completely through the panel.

In most if not all prior designs, the support struts in the foam blocks are continuous through the panel, see exemplary I-beam 12 in FIG. 1. The continuous metal structure of I-beam 12 through foam block 14 provides a continuous thermal conduction path from the interior surface to the exterior surface that reduces the R-value insulation factor of the prior art panel.

An important feature of building panel 22 is its thermal non-conductivity properties in combination with the structural strength it provides. The thermal non-conductivity property of panel 22 arises from the fact the support members extend only partially through the building panel. As seen in FIG. 2, each support member 30, on both sides of panel 22, stops in the interior portion of the insulating block 28 and does not extend completely through from the interior surface to the exterior surface of the building panel. In one embodiment, the support member extends about half way through the insulating block. In a 6-inch insulating block, the "T" support member extends about 3 inches into the insulating block. Support members 30 are typically made with metal and as such have high thermal conductive properties. The support members 30 inherently exhibit a thermal conduction path through the metal. The foam portion of panel 22 has high thermal insulation properties. Since the support members 30 do not extend all the way from the interior surface to the exterior surface of panel 22, there is no channel of high thermal conductivity from the interior surface to the exterior surface in the body of the building panel. Thus, the thermal conduction path associated with the support members is discontinuous through panel 22 as the insulating material blocks the thermal transfer at the point where the support member stops in the interior of the insulating block 28.

It is understood that thermal transfer through panel 22 is not completely eliminated with the use of support members 30 as insulating blocks 28 are not perfect thermal isolators. However, the high thermal transfer associated with the metal support members is certainly discontinuous across the wall panel 22 and as such significantly improves its R-value insulation factor for the wall panel as a whole.

The structural strength of building panel 22 arises from the arrangement of the support members 30 in the insulating blocks 28. Each "T"-shaped support member 30 has a head portion parallel to and in contact with the interior and exterior surfaces of panel 22. The stem of the "T"-shaped support member extends into the insulating block 28. The "T"-shaped support members 30 are positioned on opposite sides of panel 22, in an alternating pattern and offset or staggered with respect to the adjacent support members on the opposite side of the building panel. The embedded stem of support members 30, arranged as shown in FIG. 2, increases the structural strength of panel 22.

Figure 3:
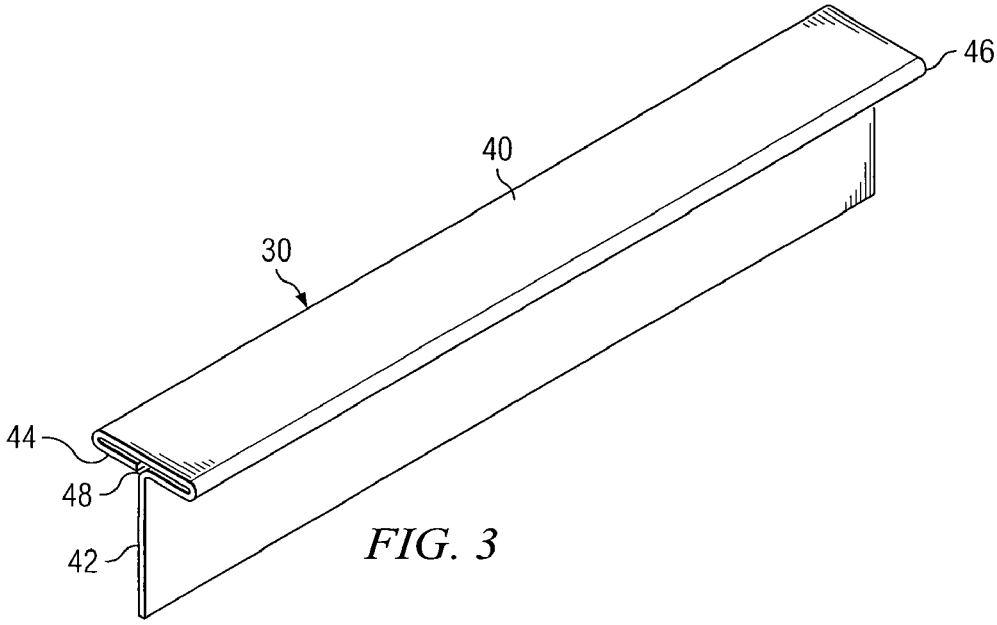
FIG. 3 illustrates a "T"-shaped support member.

The support member 30 is shown in FIG. 3 having head portion 40 and stem portion 42. The support member is formed from a rolled sheet of steel that is bent to the desired "T" shape. The steel is 20 gauge thickness, although other gauge steel could be used as well. The "T"-shape of the support member is formed using a sheet metal bending machine and process. At about 1 inch into the width of the steel plate a first 180° bend is made at point 44, commonly known as a "double-hem." At another 2 inches into the width of the steel plate a second 180° bend is made at point 46. At another 1 inch into the width of the steel plate a third bend at 90° is made at point 48. The steel plate is cut at about 3 inches past point 48 to form stem 42. The result is the double-hem "T"-shaped support member 30 having head portion 40 width of 2 inches, stem portion 42 of 3 inches, and a length the same as the height of panel 22, i.e., 8-10 feet. In other embodiments, the head portion 40 can range from 2-4 inches and the stem portion 42 can range from 1-6 inches.

Figure 4:
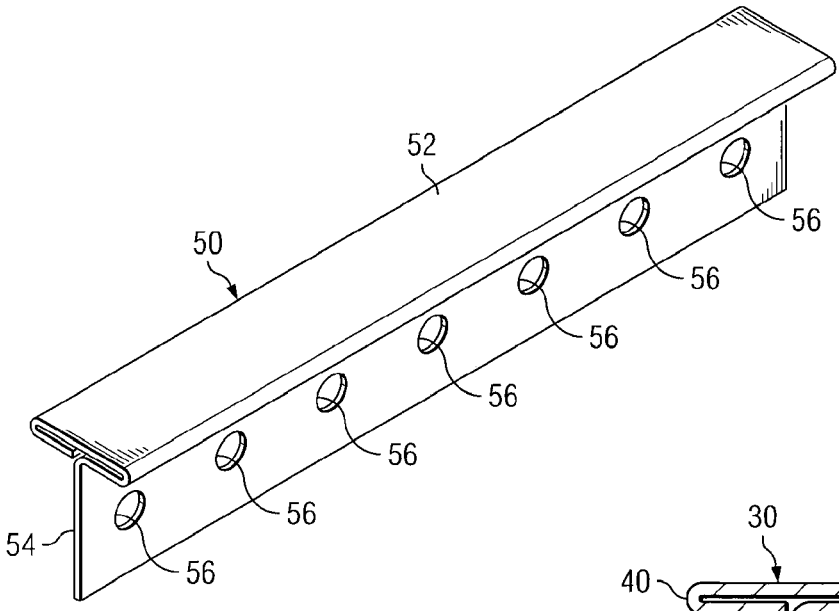
FIG. 4 illustrates the "T"-shaped support member with multiple cut-outs.
Figure 5:
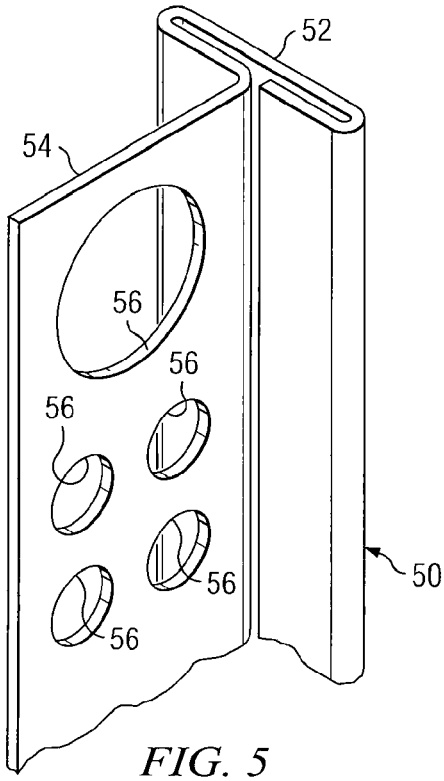
FIG. 5 illustrates the "T"-shaped support member with alternative cut-outs.

A support member 50 is shown in FIG. 4 having the same dimensions as support member 30 including head portion 52 and stem portion 54. The support member 50 has a plurality of cut-outs or openings 56 formed in the stem portion 52. FIG. 5 shows that support member 50 can have cut-outs or openings 56 of different sizes, shapes, and patterns. The cut-outs reduce the thermal conductivity and weight of the support member without significantly reducing its structural strength for panel 22.

Figure 6:
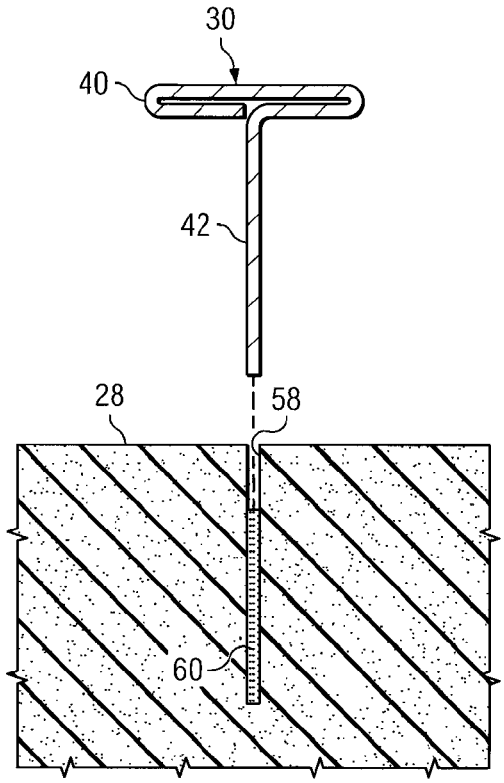
FIG. 6 illustrates the "T"-shaped support member for insertion into the foam-filled panel.

FIG. 6 illustrates in cross-section groove or slot 58 cut into a side surface of insulating blocks 28 from the bottom to the top of panel 22. For a 6-inch thick insulating block, the groove 58 is about 3 inches deep into the insulating block. An adhesive 60 such as urethane glue is disposed into groove 58. A groove 58 is cut into insulating blocks 28 of panel 22 for each support member 30. The stem portion 42 of support members 30 are then inserted into the groove 58 until the head portion 40 contacts the surface of insulating block 28. The stem portion 42 cures with adhesive 60 and forms a secure union between support member 30 and insulating block 28.

Figure 7:
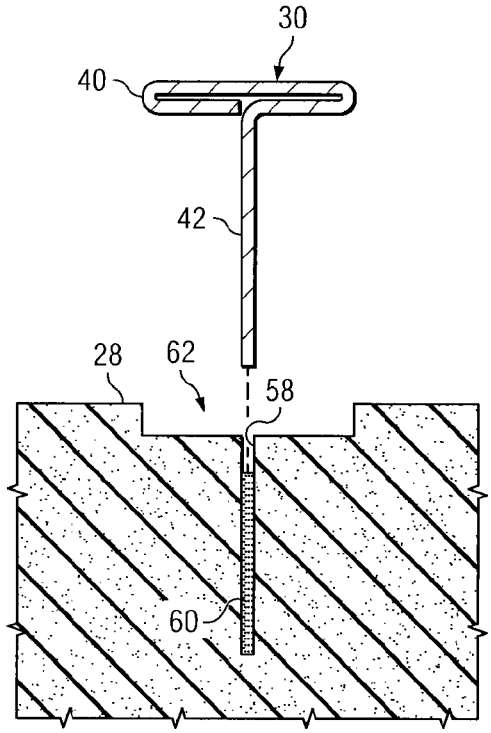
FIG. 7 illustrates the "T"-shaped support member for insertion into a recess of foam-filled panel.

In an alternative embodiment, a shallow trench or recess 62 is cut into insulating block 28 to sufficient depth to contain head portion 40, as shown in cross-section in FIG. 7. The stem portion 42 is inserted into groove 58 to cure with adhesive 60. The top surface of head portion 40 is co-planar with the side surface of insulating blocks 28 and provides a flush surface for panel 22.

Figure 8:
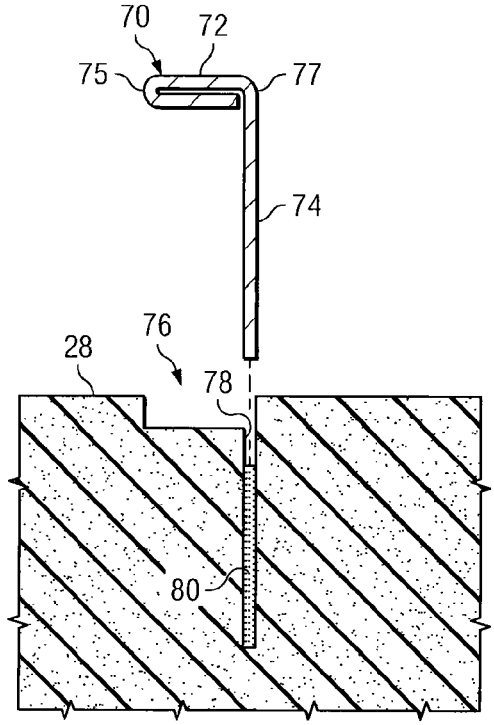
FIG. 8 illustrates an "L"-shaped support member for insertion into a recess of the foam-filled panel.

Another embodiment for the support member is shown in cross-section in FIG. 8. The "L"-shaped support member 70 has head portion 72 and stem portion 74. The support member is formed from a rolled sheet of steel that is bent to the "L" shape. About 1 inch into the width of the steel plate a first 180° bend is made at point 75. At another 1 inch into the width of the steel plate a third bend at 90° is made at point 77. The steel plate is cut at about 3 inches past point 77 to form stem 74. The result is an "L"-shaped support member 70 having head portion 72 width of 1 inch, stem portion 74 of 3 inches, and a length the same as the height of panel 22, i.e., 8-10 feet.

A shallow trench or recess 76 is cut into insulating block 28 to sufficient depth to contain head portion 72. A groove 78 cut into a side surface of insulating blocks 28 from the bottom to the top of panel 22. For a 6-inch thick insulating block, the groove 78 is cut about 3 inches deep into the insulating block. An adhesive 80 such as urethane glue is disposed into groove 78. A groove 78 is cut into insulating blocks 28 of panel 22 for each support member 30. The stem portion 74 of support members 70 are then inserted into the grooves 78 until the top surface of head portion 74 is co-planar with the side surface of insulating blocks 28. The recessed head portion provides a flush surface for panel 22.

Figure 9:
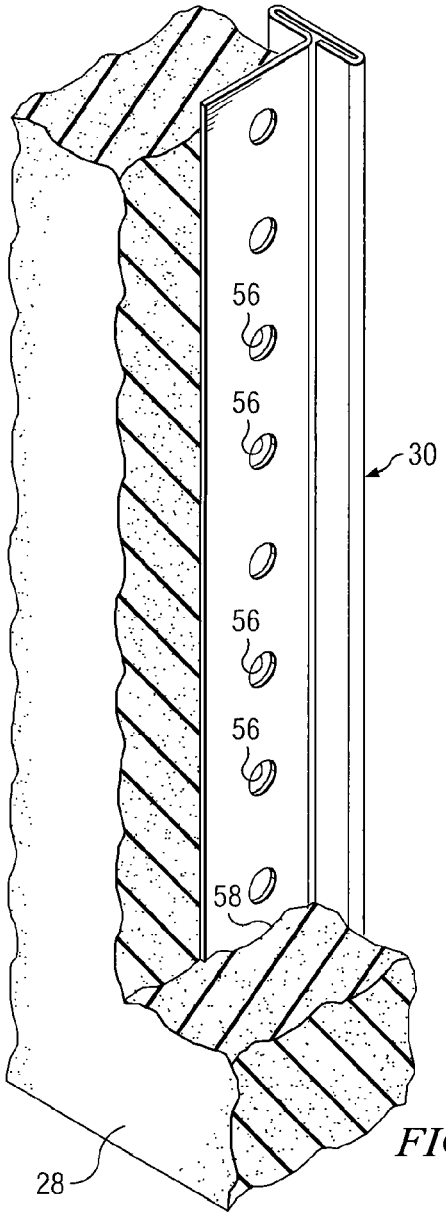
FIG. 9 illustrates a cut-away of the foam-filled panel with the "T"-shaped support member installed.

FIG. 9 shows a cut-away of insulating block 28 with support member 30 in place. Note that the cut-outs or openings 56 in the support member 30 also improve the adhesive of the stem portion to the insulating block 28. Alternatively, the stems portions can be textured, roughened, corrugated, or partially punched for better adhesion in groove 58 to the insulating block.

FIGS. 10*a*-10*f* illustrate alternative embodiments of the support members. Each figure is a cross-sectional view of panel 22.

Figure 10A:
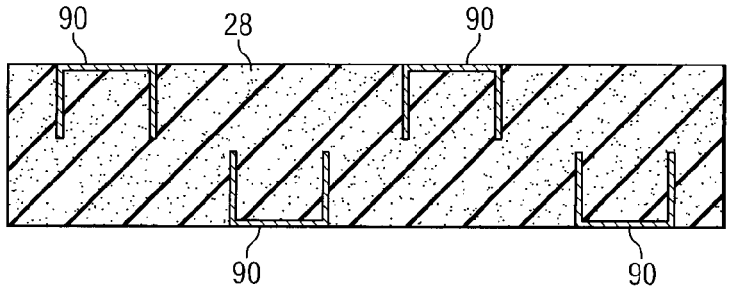
FIGS. 10*a*-10*f* illustrate a top view of the foam-filled panel with different arrangements of support members.

FIG. 10*a* shows "U"-shaped support members 90 disposed in insulating block 28 extending the height of panel 22. The "U"-shaped support members 90 are formed by making two 90° bends in the sheet of steel. The "U"-shaped support member 90 has a head portion and two stem portions extending partially into insulating block 28, but does not extend all the way through from the interior surface to the exterior surface of panel 22. Accordingly, the thermal conduction path through panel 22, attributed to the metal support members, is discontinuous. The support members 90 are installed on opposite sides of panel 22, in an alternating pattern and offset or staggered with respect to the adjacent support members on the other side of the building panel. The support members are about 12-18 inches apart on center of each member. The "U"-shaped support member 90 can also be recessed into insulating block 28 as described in FIG. 7.

Figure 10B:
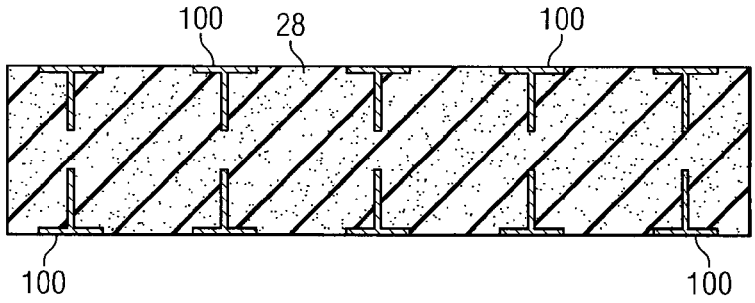

FIG. 10*b* shows "T"-shaped support members 100 disposed in insulating block 28 extending the height of panel 22. Opposing "T"-shaped support members 100 are directly opposite one another, but still do not extend all the way through from the interior surface to the exterior surface of panel 22. In the embodiment of FIG. 10*b*, there is a break or gap between opposing "T" support members 100, the space being filled with foam to block the thermal conduction path from the interior surface to the exterior surface of panel 22. Accordingly, the thermal conduction path through panel 22, attributed to the metal support members, is discontinuous.

Figure 10C:
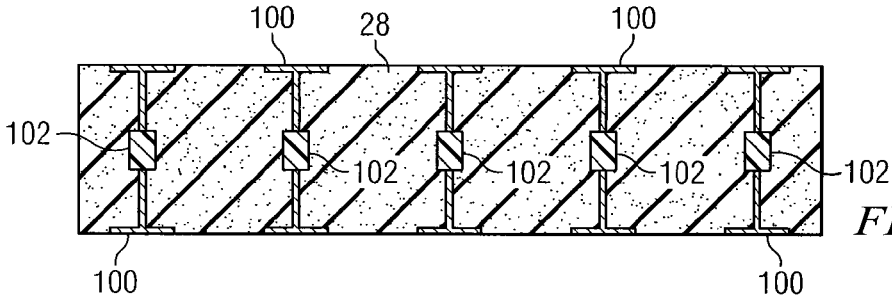

FIG. 10*c* illustrates the "T"-shaped support members 100 of FIG. 10*b* with thermally insulating connectors 102 placed between opposing "T"-shaped support members 100. The thermal insulating connectors 102 are made of plastic or other rigid thermally isolating material. The thermal insulating connectors 102 provide additional strength for the support members 100, while blocking the thermal conduction path from the interior surface to the exterior surface of panel 22. Accordingly, the thermal conduction path through panel 22, attributed to the metal support members, is discontinuous.

Figure 10D:
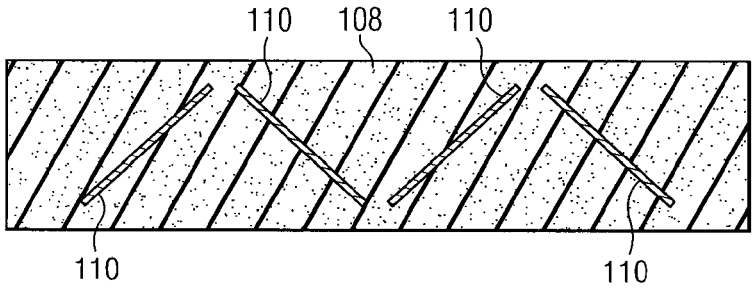

FIG. 10*d* shows straight support members 110 embedded within the interior of insulating material 108. In this embodiment, the panel 22 can be made by creating a form of the outline of the building panel. The support members 110 are placed into the form, and the form is filled with the insulating material 108, e.g., paper, foam, or fiberglass. The insulating material 108 is mixed with an adhesive to create a semi-fluid mixture that surrounds and encases the support members 110 as the form is filled. When the insulating material hardens, the panel forms are removed, leaving panel 22. The support members 110 do not extend all the way through from the interior surface to the exterior surface of panel 22. In the embodiment of FIG. 10*d*, there is a break or gap on either end of the support member 110 before the interior and exterior surfaces of panel 22. The space of the gap is filled with the insulating material 108 to block the thermal conduction path from the interior surface to the exterior surface of panel 22. Accordingly, the thermal conduction path through panel 22, attributed to the metal support members, is discontinuous.

Figure 10E:
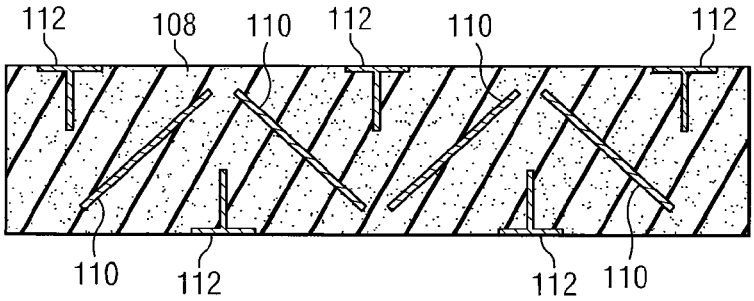

FIG. 10*e* shows straight support members 110 in combination with "T"-shaped support members 112 embedded within the interior of insulating material 108. As with FIG. 10*d*, the panel 22 can be made by creating a form of the outline of the building panel. The support members 110 and 112 are placed into the form, and the form is filled with the insulating material 108 in its semi-fluid state to surround and encase the support members 110 and 112 as the form is filled. When the insulating material hardens, the panel forms are removed, leaving panel 22. The support members 110 and 112 do not extend all the way through from the interior surface to the exterior surface of panel 22, which blocks the thermal conduction path from the interior surface to the exterior surface of panel 22. Accordingly, the thermal conduction path through panel 22, attributed to the metal support members, is discontinuous.

Figure 10F:
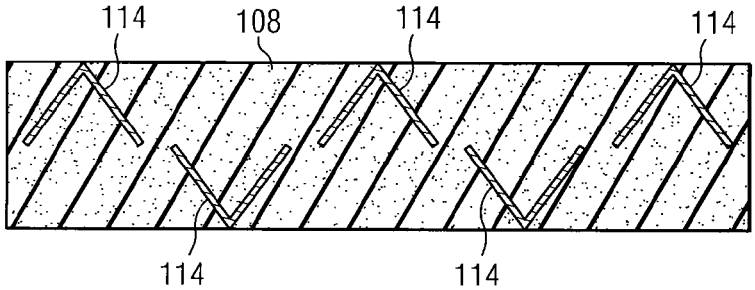

FIG. 10*f* shows angled support members 114 embedded within the interior of insulating material 108. As with FIG. 10*d*, panel 22 can be made by creating a form of the outline of the building panel. The support members 114 are placed into the form, and the form is filled with the insulating material 108. The insulating material 108 is mixed with an adhesive to create a semi-fluid mixture that surrounds and encases the support members 114 as the form is filled. When the insulating material hardens, the panel forms are removed, leaving panel 22. The support members 114 do not extend all the way through from the interior surface to the exterior surface of panel 22. In the embodiment of FIG. 10*f*, there is a break or gap on either end of the support member 114 before the interior and exterior surfaces of panel 22. The space of the gap is filled with the insulating material 108 to block the thermal conduction path from the interior surface to the exterior surface of panel 22. Accordingly, the thermal conduction path through panel 22, attributed to the metal support members, is discontinuous.

Figure 11:
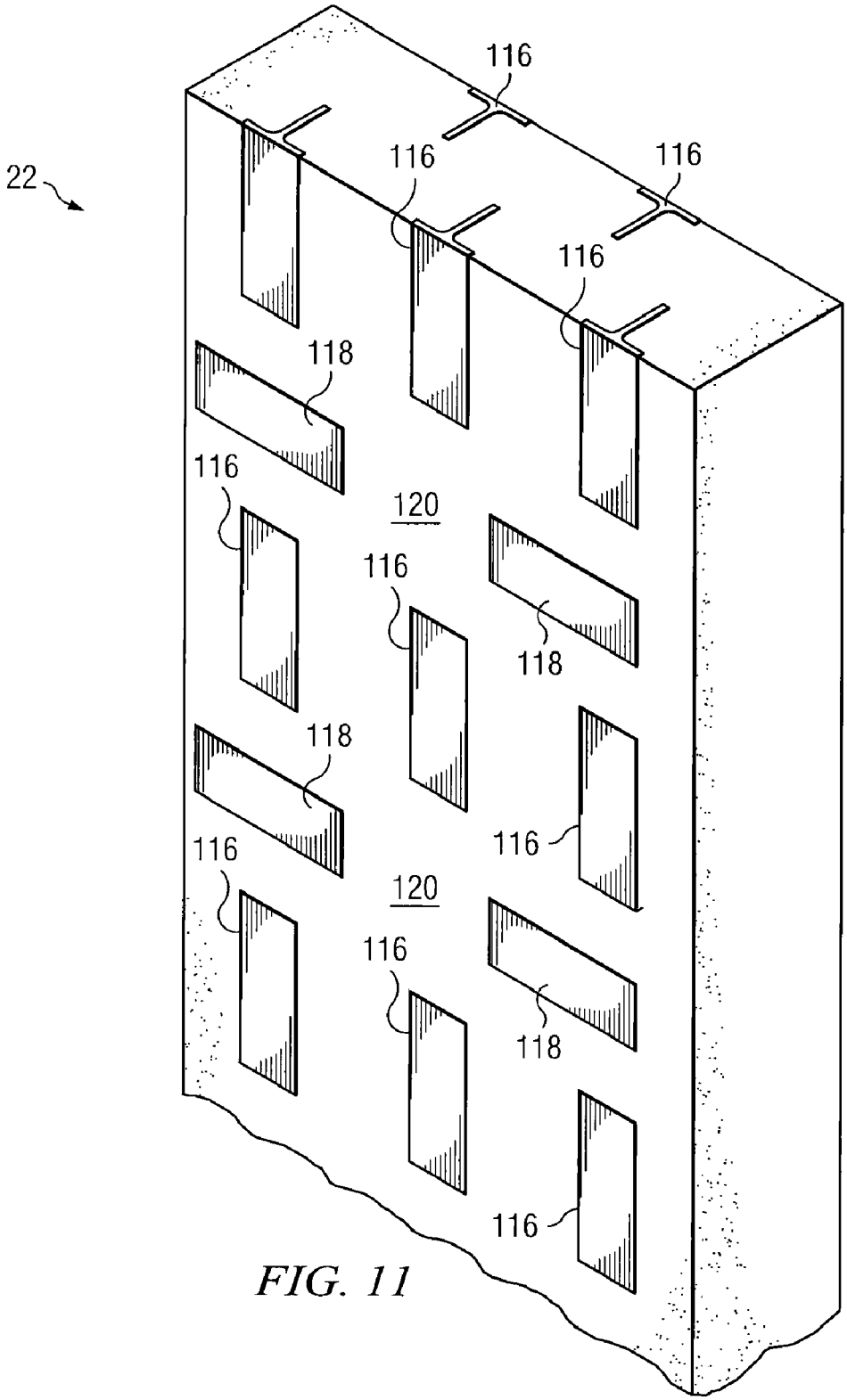
FIG. 11 illustrates the foam-filled panel with support members installed in horizontal and vertical positions.

Another embodiment of panel 22 is shown in FIG. 11. The stem of "T"-shaped support members 116 and 118 extend only partially into the insulating material. However, the support members do not extend the complete height of panel 22. Instead, panel 22 has a row of vertical support members 116, followed by a row of horizontal support members 118, followed by a row of vertical support members 116, and another row of horizontal support members 118, and so on. In areas 120, there are horizontal support members 118 on the opposite surface of panel 22.

Figure 12A:
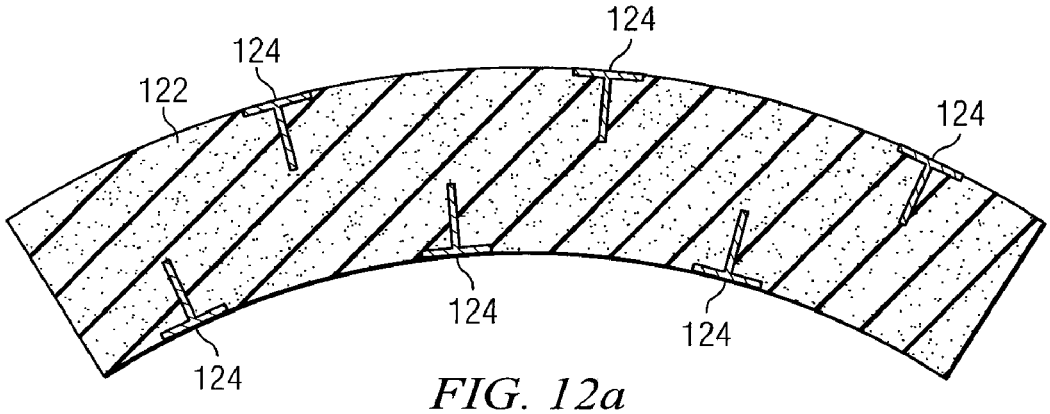
FIGS. 12*a*-12*b* illustrate alternative shapes for the foam-filled panel with support members.
Figure 12B:
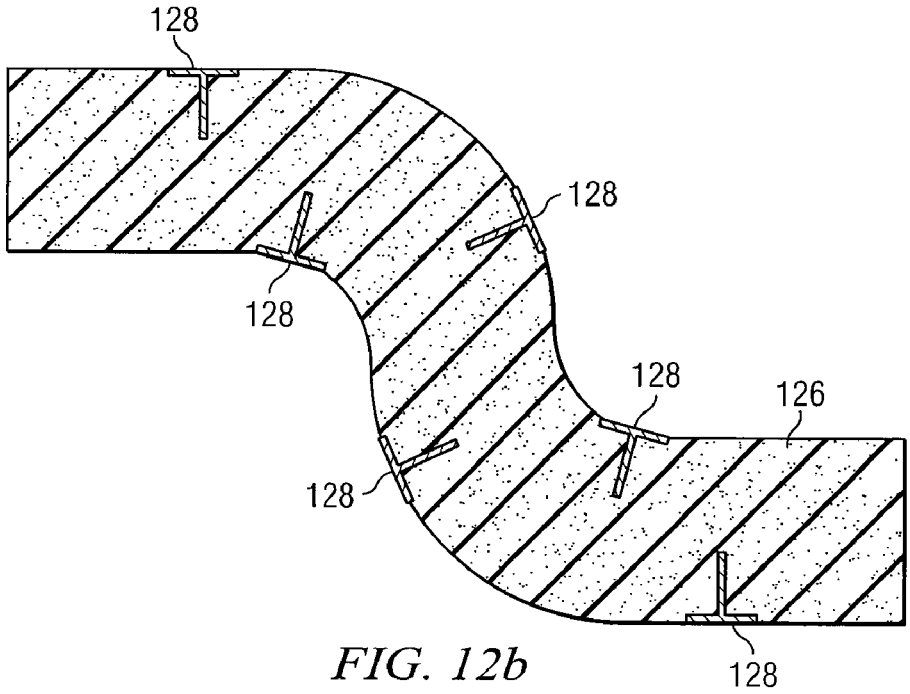

Wall panel 22 can be formed with horizontal and vertical conduits or air channels to run electric wire and plumbing pipes. Doors and windows can be cut into wall panel 22 in the manufacturing facility or at the construction site. The wall panel can be formed to any shape. FIG. 12*a* shows a curved wall panel 122 with "T" support members 124. FIG. 12*b* shows an "S" shaped wall panel 126 with "T" support members 128.

Roof panels for the building structure 20 can be manufactured as described for building panel 22. The same is true for floor and ceiling panels. Since roof panels rest at an angle or flat, these panels may include additional support for vertical loads bearing into the surface of the panel.

Figure 13:
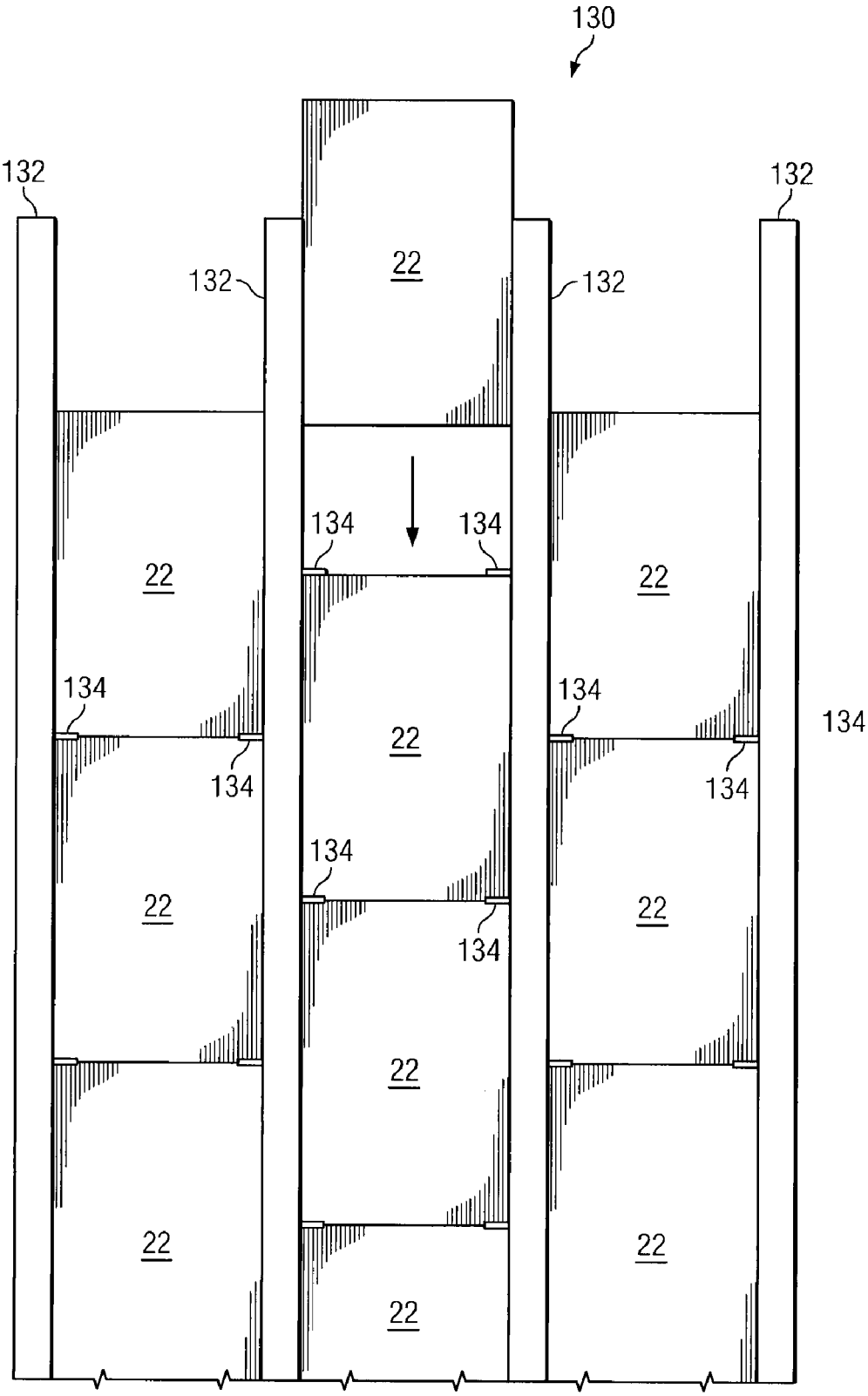
FIG. 13 illustrates the use of foam-filled panels in high-rise buildings between frame columns.

Another application for panel 22 involves high-rise construction. Most high-rise buildings have a frame structure with curtain wall panels placed between columns of the frame structure. Building panels like 22 are ideally suited to be disposed between the frame structure of a high-rise building. In FIG. 13, frame structure 130 has columns 132 made of red iron or steel. Curtain wall panels 22 are placed between columns 132 and rest on ears 134 or are pinned to columns 132. Once in position, curtain wall panels 22 are welded to columns 132. The curtain wall panel has an exterior surface that can be covered with mesh, sto, dinsglass, and an exposure surface such as stucco, granite, brick, or slate. The interior surface of the curtain wall panel has sheet rock and decorative covering such as paint or wall paper. Curtain wall panel 22 can be formed with horizontal and vertical conduits or air channels or chases to run electric wire and plumbing pipes. Alternatively, foam-filled panel 22 can be formed within another panel that acts as the curtain wall panel. The electric and plumbing lines can be placed in gaps between the curtain wall panel and the inner foam-filled panel 22.

Panels like 22 have applications in many other industries, such as aircraft fuselage, automobile bodies, and marine hulls. The panels are strong, exhibit high thermal insulation properties, and can be formed to any size and shape, which would be well-suited to such applications.

While one or more embodiments of the present invention have been illustrated in detail, the skilled artisan will appreciate that modifications and adaptations to those embodiments may be made without departing from the scope of the present invention as set forth in the following claims.

What is claimed is:

1. A method of manufacturing a building panel for use in building a residential or commercial structure off-site at a manufacturing location that is geographically separate from an assembly location where the building panel is incorporated into the residential or commercial structure, said method comprising:

assembling a plurality of panel forms to form a panel mold having a hollow cavity within the panel mold, an overall size and shape of the hollow cavity substantially defining an overall size and shape of the building panel, a width of the hollow cavity and a height of the hollow cavity substantially defining a width of the building panel and a height of the building panel, respectively;

providing a first metal sheet;

bending the first metal sheet to form a first T-shaped support member having a length that is substantially the same as a length of the first metal sheet, wherein bending the first metal sheet to form the first T-shaped support member consists of:

bending the first metal sheet by substantially 90 degrees across the length of the first metal sheet to form a first portion of the first metal sheet and a second portion of the first metal sheet that is substantially perpendicular to the first portion of the first metal sheet, a length of the first portion of the first metal sheet less than the width of the hollow cavity;

bending the second portion of the first metal sheet by substantially 180 degrees across the length of the first metal sheet to form a third portion of the first metal sheet that is substantially parallel to the second portion of the first metal sheet; and bending the third portion of the first metal sheet by substantially 180 degrees across the length of the first metal sheet to form a fourth portion of the first metal sheet such that the fourth portion of the first metal sheet is parallel to the third portion of the first metal sheet, and such that an end of the first metal sheet lies proximate to where the first metal sheet was bent by substantially 90 degrees across the length of the first metal sheet to form the first portion of the first metal sheet and the second portion of the first metal sheet;

disposing the first T-shaped support member within the hollow cavity such that the length of the first T-shaped support member is substantially parallel to the height of the hollow cavity, such that the third portion of the first metal sheet substantially abuts an interior surface of the panel mold, and such that the first portion of the first metal sheet is substantially parallel to the width of the panel mold;

providing a second metal sheet to form a planar support member having a length that is substantially the same as a length of the second metal sheet;

disposing the planar support member within the hollow cavity such that the length of the planar support member is substantially parallel to the height of the hollow cavity, such that the planar support member does not contact the interior surface of the panel mold, and such that the planar support member forms a first angle with the interior surface of the panel mold, wherein the first angle is not a right angle;

filling an unoccupied space in the hollow cavity of the panel mold with a semi-fluid insulating material; and solidifying the semi-fluid insulating material to form an insulating material that surrounds and encases at least the first T-shaped support member and the planar support member.

2. The method of claim 1, further comprising:

providing a third metal sheet;

bending the third metal sheet to form a second T-shaped support member having a length that is substantially the same as a length of the third metal sheet, wherein bending the third metal sheet to form the second T-shaped support member consists of:

bending the third metal sheet by substantially 90 degrees across the length of the first metal sheet to form a first portion of the third metal sheet and a second portion of the third metal sheet that is substantially perpendicular to the first portion of the third metal sheet, a length of the first portion of the third metal sheet less than the width of the hollow cavity;

bending the second portion of the third metal sheet by substantially 180 degrees across the length of the third metal sheet to form a third portion of the third metal sheet that is substantially parallel to the second portion of the third metal sheet; and bending the third portion of the third metal sheet by substantially 180 degrees across the length of the third metal sheet to form a fourth portion of the third metal sheet such that the fourth portion of the third metal sheet is parallel to the third portion of the third metal sheet, and such that an end of the third metal sheet lies proximate to where the third metal sheet was bent by substantially 90 degrees across the length of the third metal sheet to form the first portion of the third metal sheet and the second portion of the third metal sheet;

disposing the second T-shaped support member within the hollow cavity such that the length of the second T-shaped support member is substantially parallel to the height of the hollow cavity, such that the third portion of the third metal sheet substantially abuts another interior surface of the panel mold, and such that the first portion of the third metal sheet is substantially parallel to the width of the panel mold, wherein the interior surface of the panel mold and the another interior surface of the panel mold are opposite to each other.

3. The method of claim 2, wherein the first T-shaped support member and the second T-shaped support member are offset from one another such that a line drawn from where the first portion of the first metal sheet meets the second portion of the first metal sheet to where the first portion of the third metal sheet meets the second portion of the second metal sheet forms a second angle with the interior surface of the panel mold, wherein the second angle is not a right angle.

4. The method of claim 3, wherein the planar support member is disposed in the hollow cavity such that the line drawn from where the first portion of the first metal sheet meets the second portion of the first metal sheet to where the first portion of the third metal sheet meets the second portion of the second metal sheet is substantially perpendicular to the planar support member.

5. The method of claim 2, further comprising disposing the first T-shaped support member and the second T-shaped support member within the hollow cavity such that the first portion of the first metal sheet and the first portion of the second metal sheet are disposed in substantially the same plane.

6. The method of claim 5, further comprising disposing the first T-shaped support member and the second T-shaped support member within the hollow cavity such that the first portion of the first metal sheet and the first portion of the second metal sheet do not touch one another.

7. A method of manufacturing a building panel, comprising:

providing an insulating block;

providing a first metal sheet;

bending the first metal sheet no more than three times to form a first support member consisting of a head portion and a stem portion, the head portion and the stem portion substantially planar in shape, the stem portion disposed substantially perpendicular to the head portion, wherein bending the first metal sheet no more than three times to form the first support member consists of:

(a) bending the first portion of the first metal sheet by substantially 180 degrees to form a second portion of the first metal sheet that is substantially parallel to the first portion of the first metal sheet, and (b) bending the second portion of the first metal sheet by substantially 180 degrees to form a third portion of the first metal sheet such that the first, second, and third portions of the first metal sheet form the head portion of the first support member; and attaching the first support member to the insulating block such that a length of the first support member is substantially parallel to a height of the insulating block, such that the head portion abuts a surface of the insulating block and the stem portion partially penetrates the insulating block from the surface of the insulating block, wherein the surface of the insulating block is normal to a thickness of the insulating block, the thickness of the insulating block less than the height of the insulating block and less than a width of the insulating block.

8. The method of claim 7, further comprising:

providing a second metal sheet to form a second support member that is substantially planar;

encasing the second support member within the insulating block such that a length of the second support member is substantially parallel to the height of the insulating block and such that the second support member is surrounded by the insulating block.

9. The method of claim 8, wherein encasing the second support member within the insulating block comprises disposing the second support member within the insulating block in an angled manner such that a plane containing a width and a length of the second support member and a plane that is parallel to the length of the insulating block forms an angle that is less than ninety degrees.

* * * * *